US006109587A

United States Patent [19]

Peacock et al.

[11] Patent Number: 6,109,587

[45] Date of Patent: Aug. 29, 2000

[54] MANHOLE LIFT INSERT LOCATOR

[75] Inventors: Bobbie D. Peacock, Peachtree City; Charles W. McInvale, Brooks, both of Ga.

[73] Assignee: M.A. Industries, Inc., Peachtree City, Ga.

[21] Appl. No.: 08/938,528

[22] Filed: Sep. 26, 1997

[51] Int. Cl.[7] ..... B28B 23/00

[52] U.S. Cl. ..... 249/91; 249/93; 249/205

[58] Field of Search ..... 249/91, 93, 94, 249/97, 205

[56] References Cited

U.S. PATENT DOCUMENTS

| | | | |
|---|---|---|---|
| 3,680,826 | 8/1972 | Bassani | 249/91 |
| 3,982,363 | 9/1976 | Dorris | 52/98 |
| 4,159,099 | 6/1979 | Maguire | 249/93 |
| 4,427,173 | 1/1984 | MacKay | 249/93 |
| 4,749,170 | 6/1988 | Ase | 249/93 |
| 4,948,089 | 8/1990 | Knodel et al. | 249/91 |

OTHER PUBLICATIONS

Photographs showing side elevational and top perspective views of prior lift insert locator device.

*Primary Examiner*—James P. Mackey
*Attorney, Agent, or Firm*—John S. Pratt, Esq.; Kristin L. Johnson, Esq.; Kilpatrick Stockton LLP

[57] ABSTRACT

A manhole lift insert positioning apparatus consisting of: (1) a threaded nut imbedded in a thermoplastic elastomer molding that fits snugly within a lift insert, and (2) a threaded wing bolt to engage the nut and expand the molding within the insert, thereby locking it in position and drawing the molding against the inside face of the concrete form, thus sealing the insert opening to avoid obstruction of that opening with concrete.

7 Claims, 5 Drawing Sheets

12
20
42
48
38
45
22
43
41
26
40
24
36
44
34
46
35
32
30
28

12
40
42
22
44
46
32
35
28

MANHOLE LIFT INSERT LOCATOR

FIELD OF THE INVENTION

This invention relates to manhole lift inserts and devices for positioning such inserts in concrete molds used to form manholes and other pre-cast concrete products.

BACKGROUND OF THE INVENTION

Manhole lifts are eye bolt-like devices 10 illustrated in FIGS. 5 and 6 that are positioned within a lift insert 12 imbedded in concrete 50 that forms a manhole or other precast concrete product. Manhole lift 10 permits the attachment of chains and other devices to lift a pre-cast concrete product in order to transport it and ultimately position it where it is to be used.

Lift inserts 12 have a bayonet-type socket, and lifts 10 have bayonet-type bases formed by two opposed ears 16 on the lift shaft 18 that are received in opposed grooves 20 in insert 12. After lift 10 is fully inserted in insert 12, it is rotated one quarter turn, as shown in FIG. 6, to lock it in place so that it will not withdraw from insert 12.

Prior devices for holding insert 12 in position within a manhole or other pre-cast concrete product form have utilized expensive, relatively complex devices with a spring loaded shaft having a bayonet base that locks within the bayonet socket in an insert 12 in the same manner as a manhole lift 10 locks in insert 12. The expense, complexity and other problems associated with such devices make it desirable to have a simpler, easier to use device for holding a lift insert 12 in position during the concrete casting process.

SUMMARY OF THE INVENTION

The present invention is a manhole lift insert positioning apparatus consisting of two principal parts. In the first part, a threaded nut is imbedded in a rubber molding that fits snugly within a lift insert. A threaded wing bolt positioned in a hole in the pre-cast form engages the nut to draw it toward the form wall squeezing the molding axially so that it expands radially against the inside of the insert. This locks the insert in position and draws the molding against the inside face of the concrete form, thus sealing the insert opening to avoid obstruction of that opening with concrete.

DETAILED DESCRIPTION OF THE DRAWINGS

Figures 1, 2:
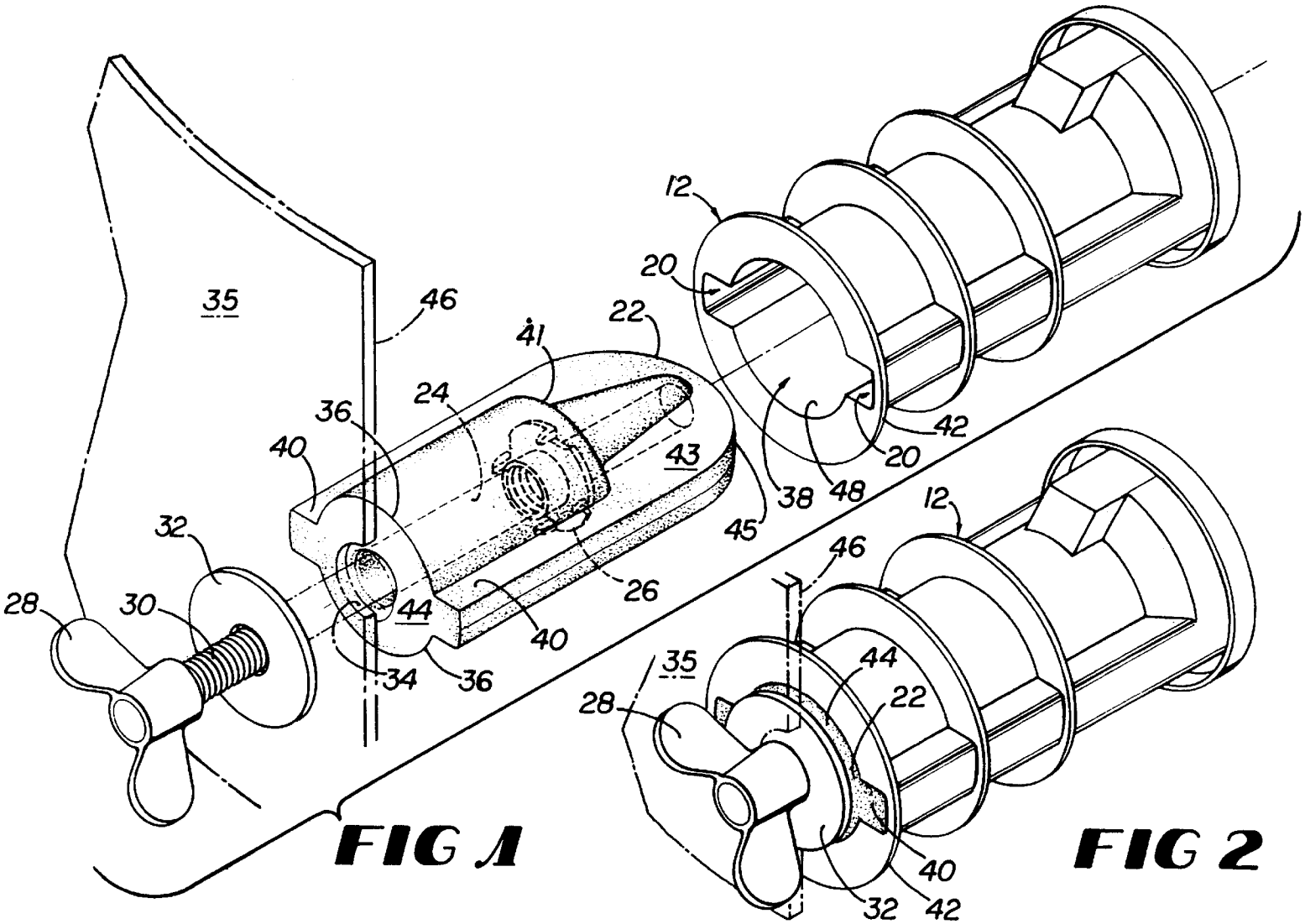
FIG. 1 is an exploded perspective view of the lift insert locator of the present invention shown with a lift insert and a portion of a concrete form wall shown in broken lines.
FIG. 2 is a perspective view similar to FIG. 1 showing the components of FIG. 1 assembled.

The insert locating apparatus of the present invention utilizes a body or molding 22 of rubber or other similarly resilient material that is penetrated by an opening 24 and that is formed around an engagement member such as a tee-nut 26. Tee-nut 26 receives a force exerting component such as threaded "butterfly" or "wing" bolt 28 having a shaft 30 that passes through an optional washer 32, and a hole 34 in the wall 35 of a concrete form, and then into opening 24 in molding 22 and through tee-nut 26.

Molding 22 has a generally cylindrical section 36 shaped to fit snugly within the generally cylindrical recess 38 in insert 12. Two "wings" 40 that are generally rectangular cross-section ridges are attached on opposite sides of cylindrical section 36 to fit snugly within grooves 20 in insert 12. The wings 40 extend around end 41 of cylindrical section 36 to form a plate 43 having a half-round or semi-circular edge 45. This edge 45 facilitates insertion of molding 22 in insert 12 by easily starting wings 40 in grooves 20 as molding 22 is slipped into insert 12. The exact shape of molding 22 is not critical but, importantly, it is shaped so that the entire opening into recess 38 and grooves 20 defined by collar 42 on insert 12 is fully occupied when molding 22 is seated in insert 12, as is illustrated in FIG. 2. The face 44 of molding 22 is essentially flat. That face 44 lies against the inside surface 46 of form wall 35, thereby insuring, as is readily apparent in FIG. 2, that concrete does not enter insert 12 or form across the opening 38 into recess 38 and grooves 20 of insert 12. By essentially fully occupying the inside of insert 12 adjacent to its collar 42, molding 22 effectively precludes concrete from seeping into or solidifying in that space.

Figure 3:
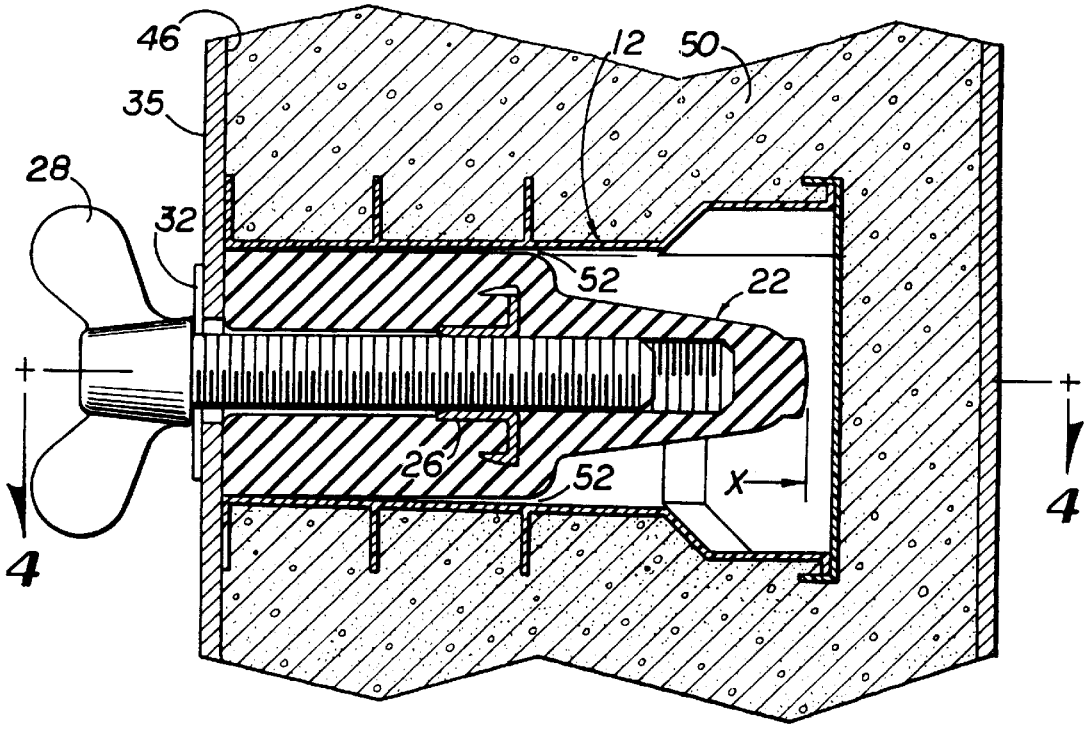
FIG. 3 is a side elevation view of the lift insert and insert positioning apparatus of FIG. 1 shown in section positioned within a concrete form filled with concrete.
Figure 4:
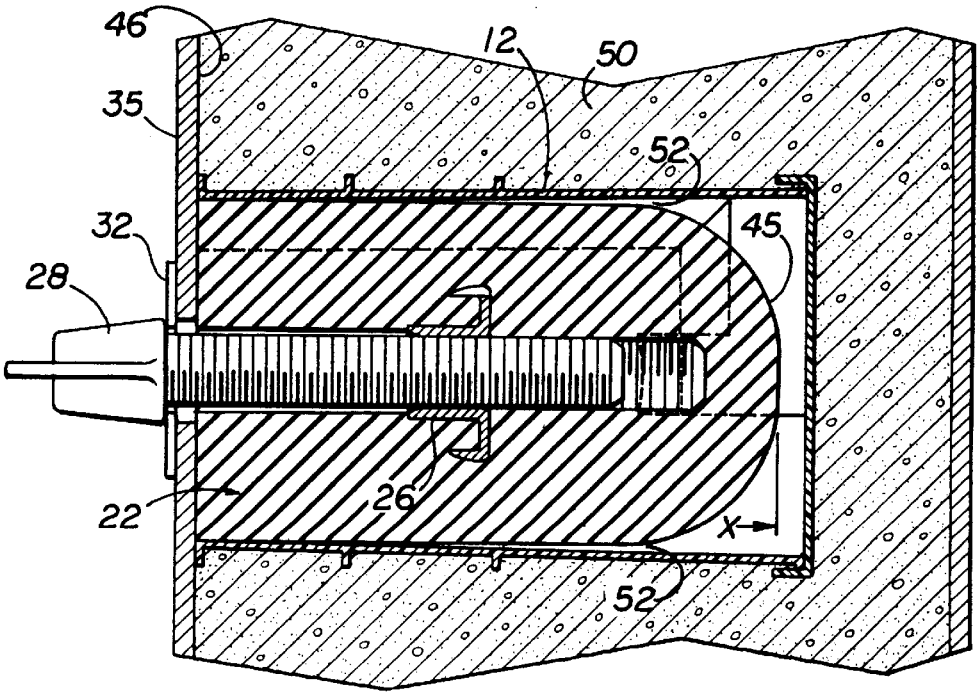
FIG. 4 is a section view taking a long line 4—4 in FIG. 3.
Figure 3A:
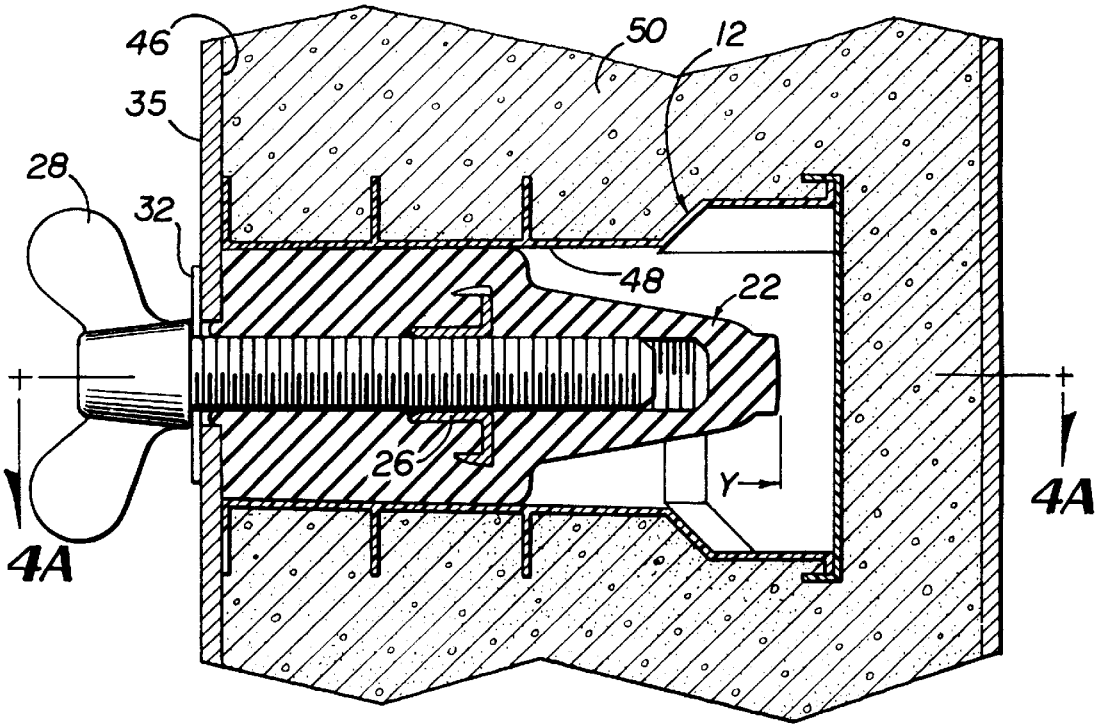
FIG. 3A is a view of the present invention similar to FIG. 3 except that the wing bolt has been tightened.
Figure 4A:
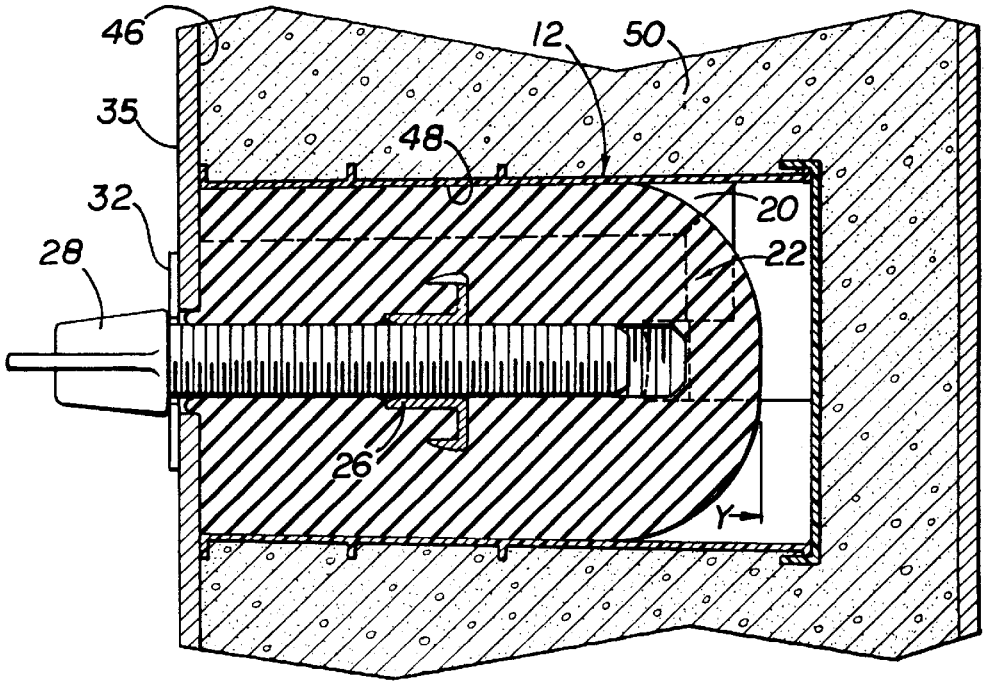
FIG. 4A is a view similar to FIG. 4 except that the wing bolt has been tightened.
Figures 5, 6:
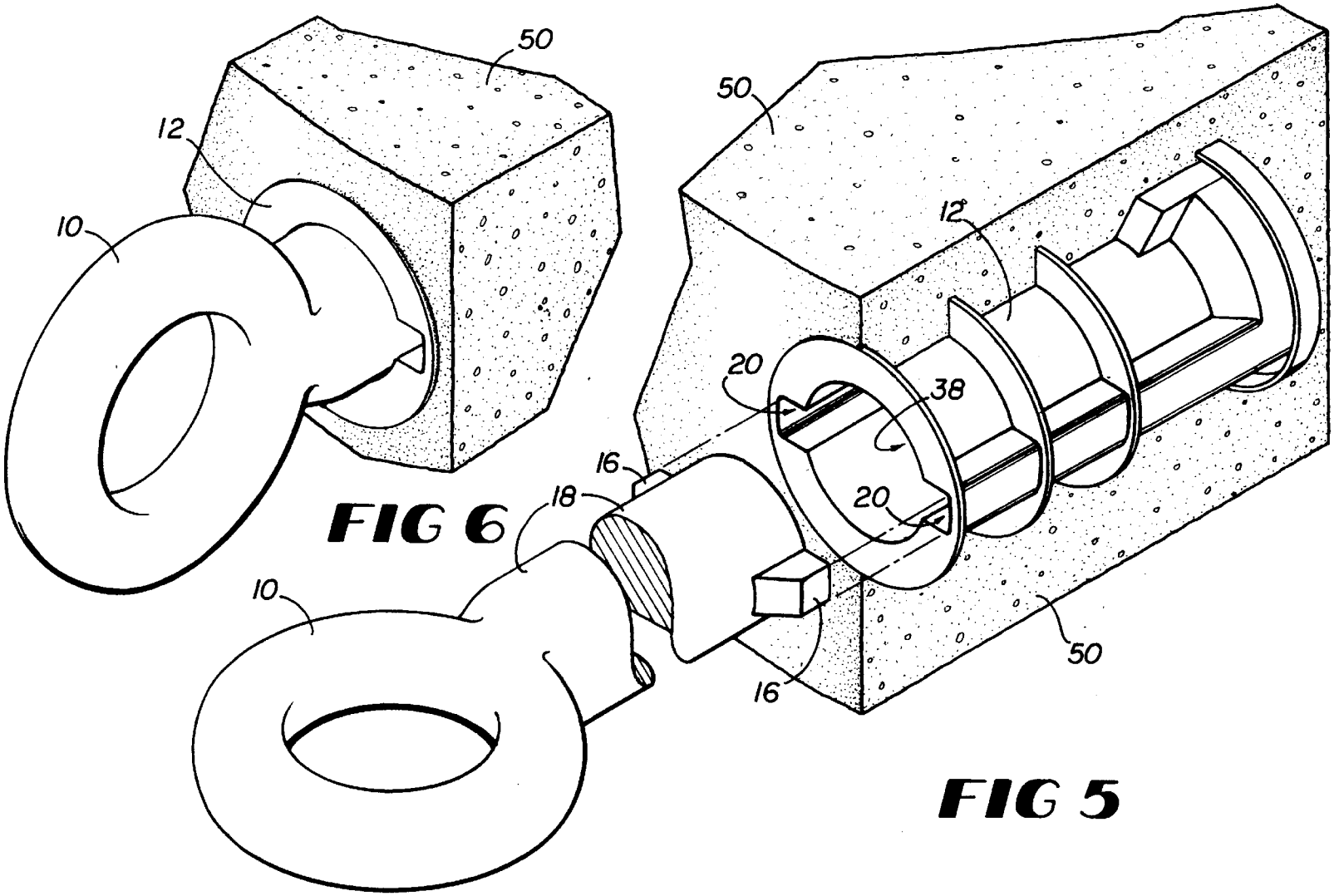
FIG. 5 is an exploded perspective view of a manhole lift and a lift insert positioned in concrete.
FIG. 6 is a perspective view showing the externally visible portion of insert 12 imbedded in concrete with a lift locked within the insert.

As may be readily appreciated by comparison of FIG. 3 to FIG. 3A and FIG. 4 to 4A, molding 22 is locked in position, securing insert 12 in position against the inside face 46 of concrete form wall 35, by tightening wing bolt 28, thereby drawing tee-nut 26 toward form wall 35 inside surface 46. As is illustrated in FIGS. 3 and 4, when wing bolt 28 has not been tightened, there is a gap 52 between molding 22 and the insert 12. Tightening wing bolt 28 draws tee-nut 26 to the left in FIGS. 3, 3A, 4 and 4A, thereby compressing molding 22 along the longitudinal axis of bolt 28 and causing molding 22 to expand radially and eliminate gap 52, as may be seen in FIGS. 3A and 4A. This causes molding 22 simultaneously to firmly grip insert 12, draw the collar 42 of insert 12 into firm contact with inside surface 46 of form wall 35, and seal the face 44 of molding 22 against inside surface 46 of form wall 35. This assures that insert 12 is properly positioned during the concrete forming process and that concrete does not obstruct the opening of insert 12.

FIGS. 7A through 7G graphically illustrate the steps in utilizing the present invention to hold an insert 12 in place within a concrete form during the manufacture of a manhole or other pre-cast concrete structure within which an insert 12 is positioned.

Figure 7A:
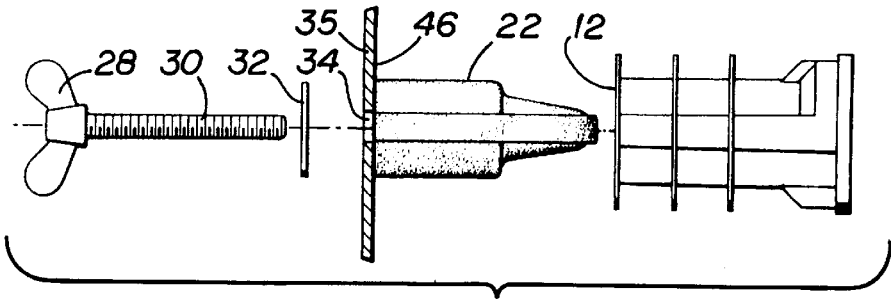
FIGS. 7A through 7G show the sequence of operations in the present invention in forming a concrete structure having an insert.
Figure 7B:
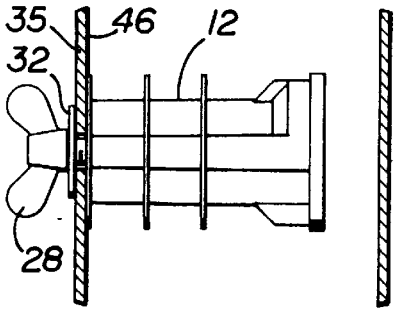

As FIG. 7A illustrates, an insert 12 is slipped over molding 22 and positioned on a concrete form wall 35 by passing wing bolt 28 through a washer 32 and a hole 34 in the concrete form wall 35. Wing bolt 28 is then rotated in order to compress and expand molding 22 as described above and firmly lock insert 12 in position as shown in FIG.

Figure 7E:
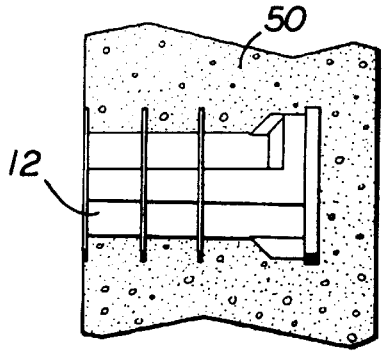
Figure 7C:
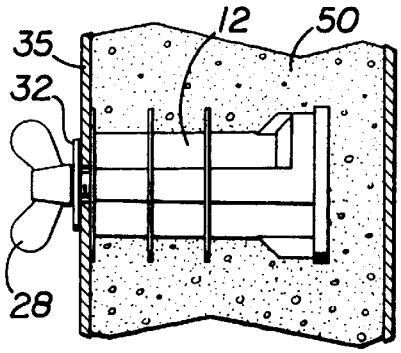

7B. Concrete 50 is then placed in the form, as shown in FIG. 7C. After the concrete has sufficiently cured, wing bolt 28 and washer 32 are removed as shown in FIG. 7D. As FIG. 7E illustrates, the concrete casting 50 is then removed from the form.

Figure 7F:
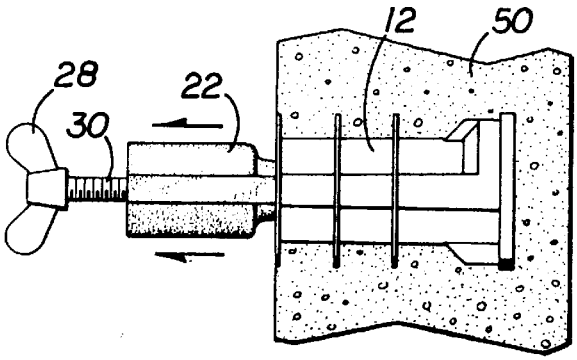
Figure 7D:
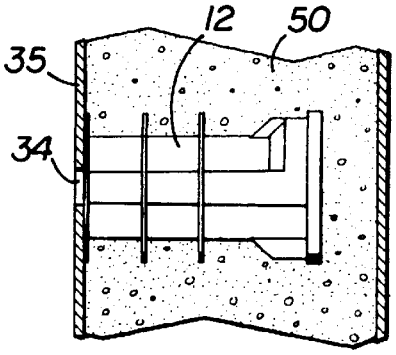

As shown in FIG. 7F, wing bolt 28 is then inserted in tee-nut 26 and rotated in order to engage the tee-nut, but wing bolt 28 is not tightened. Molding 22 is then withdrawn from insert 12 by exertion of axial force on wing nut 28.

Figure 7G:
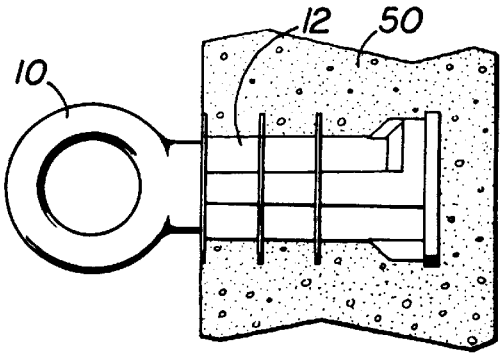

Finally, as shown in FIG. 7G, a manhole lift 10 may be inserted and locked in the insert.

As will be readily appreciated by those skilled in the art, the foregoing description and the drawings detail only one embodiment of the present invention, which is not limited to those details but may be modified extensively in accordance with the spirit of the preceding description while remaining within the scope with the following claims.

For instance, molding 22 may be fabricated of a wide variety of resilient materials. Usable materials include injection molded thermoplastic elastomers such as 60A to 90A hardness polyurethane, especially 70A hardness material, and natural and synthetic rubbers and other polymeric materials, provided that such materials have the ability to deform in the described manner. Additionally, molding 22 may be fabricated in a wide variety of shapes while achieving the objective of the present invention. For instance, the length of "wings" 40 could be reduced so that there are merely two relatively small "ears" on either side of the cylindrical section 36, which ears would occupy only a small, portion of grooves 20 adjacent to collar 42 of insert 12. Similarly, wing nut 28 could alternatively be a rod that engages a fastener within molding 22 having a bayonet socket or another alternative to the threaded engagement illustrated, and axial pressure could be exerted using, for instance, a spring, lever or cam mechanism rather than using a screw thread.

The fundamental concepts of the present invention could also be practiced using, as an alternative to a resilient rubber (or other material) molding 22, a multi-piece body of essentially rigid material like metal, which pieces spread as a nut or other engagement member is drawn toward the concrete form wall 35, thereby locking the body pieces against the inside wall 48 of insert 12.

We claim:

1. A pre-cast concrete product lift insert locator for positioning a lift insert having an inside surface against a concrete form wall, the locator comprising:

a) a body shaped to fit snugly within at least a portion of the insert, the body comprising a molding of resilient material having a generally cylindrical section and opposed wings positioned on either side of the cylindrical section, b) an engagement member connected to the body, and c) a force exerting component for exerting force on the engagement member toward the form wall to force a portion of the body against the form wall, wherein force exerted on the engagement member urges another portion of the body against the inside surface of the insert to removably lock the body within the insert.

2. The locator of claim 1, wherein the wings extend around an end of the cylindrical section and join to form a plate having a semi-circular edge.

3. The locator of claim 2, wherein the body comprises thermoplastic elastomer.

4. The locator of claim 1, wherein the engagement member is a tee-nut captured within the body, and the force exerting component is a threaded bolt to be received within the tee-nut.

5. A pre-cast concrete product lift insert locator for positioning a lift insert having an inside surface against a concrete form wall, the locator comprising:

a) means for engaging the lift insert by frictional contact with the inside surface, the engaging means comprising a body member shaped to fit snugly within at least a portion of the insert, the body member further comprising a molding of resilient material having a generally cylindrical section and opposed wings positioned on either side of the cylindrical section, and b) means for attaching the engaging means at a predetermined location on the concrete form wall.

6. A pre-cast concrete manhole lift insert locator for positioning a lift insert having an inside surface against a concrete form wall, the locator comprising:

(a) a thermoplastic elastomer molding shaped to fit snugly within at least a portion of the insert with substantial contact between the molding and the inside surface, (b) a threaded tee-nut imbedded in the molding, and (c) a threaded wing bolt for positioning within a hole in the concrete form wall and threading into the tee-nut.

7. A pre-cast concrete manhole lift insert locator for positioning a lift insert having an inside surface against a concrete form wall, the locator comprising:

a) a thermoplastic elastomer molding shaped to fit snugly within at least a portion of the insert with substantial contact between the molding and the inside surface, the molding comprising a generally cylindrical section and opposed wings that are positioned on either side of the cylindrical section and extend around an end of the cylindrical section and join to form a plate having a semi-circular edge, b) a threaded tee-nut imbedded in the molding, and c) a threaded wing bolt for positioning within a hole in the concrete form wall and threaded into the tee-nut.

* * * * *